US009327859B1

(12) United States Patent
Watkins et al.

(10) Patent No.: US 9,327,859 B1
(45) Date of Patent: May 3, 2016

(54) METAL BOTTLE TYPE CONTAINER AND RELATED METHODOLOGY

(71) Applicant: Evergreen Packaging Technology, LLC, Arvada, CO (US)

(72) Inventors: Evan D. Watkins, Evergreen, CO (US); Michael Atkinson, Lafayette, CO (US)

(73) Assignee: Aleco Container, LLC, Arvada, CO (US)

( * ) Notice: Subject to any disclaimer, the term of this patent is extended or adjusted under 35 U.S.C. 154(b) by 0 days.

(21) Appl. No.: 14/042,439

(22) Filed: Sep. 30, 2013

Related U.S. Application Data

(60) Provisional application No. 61/708,517, filed on Oct. 1, 2012.

(51) Int. Cl.
*B65D 1/42* (2006.01)
*B65D 1/02* (2006.01)

(52) U.S. Cl.
CPC ..... *B65D 1/0207* (2013.01)

(58) Field of Classification Search
CPC ..... B65D 1/0246; B65D 1/0207; B65D 35/06
USPC ..... 220/640, 641, 656–658, 703; 215/40, 215/42–44, 316, 324, 328
See application file for complete search history.

(56) References Cited

U.S. PATENT DOCUMENTS

| | | | | |
|---|---|---|---|---|
| 1,941,632 | A | 1/1934 | Staniland | |
| 2,157,896 | A * | 5/1939 | Held | 215/43 |
| 3,844,443 | A | 10/1974 | Cudzik | |
| 4,181,239 | A * | 1/1980 | Heiremans et al. | 220/62.12 |
| 4,262,815 | A | 4/1981 | Klein | |
| 4,294,373 | A * | 10/1981 | Miller et al. | 220/606 |
| 4,574,975 | A | 3/1986 | Taylor et al. | |
| 4,793,510 | A | 12/1988 | Arfert et al. | |
| 4,911,323 | A | 3/1990 | Arfert et al. | |
| 5,718,352 | A * | 2/1998 | Diekhoff et al. | 220/669 |
| 2006/0108315 | A1 | 5/2006 | Britton | |
| 2008/0047922 | A1 * | 2/2008 | Olson et al. | 215/40 |
| 2012/0024813 | A1 * | 2/2012 | Nakagawa et al. | 215/40 |

FOREIGN PATENT DOCUMENTS

JP 2011116456 A * 6/2011

OTHER PUBLICATIONS

Watkins, Evan D.; Atkinson, Michael; U.S. Appl. No. 13/215,055, filed Aug. 22, 2011 for "Indexing Machine with a Plurality of Work Stations," 51 pages.
Atkinson, Michael; Watkins, Evan D.; Kelley, Donna; Hunnel, James; U.S. Appl. No. 13/947,972, filed Jul. 22, 2013 for "Container Body Trimming Apparatus and Method," 37 pages.
(Continued)

*Primary Examiner* — Shawn M Braden
(74) *Attorney, Agent, or Firm* — William P. O'Meara, Esq.; Klaas, Law, O'Meara & Malkin PC

(57) ABSTRACT

A container is disclosed that has a drawn and ironed aluminum container body. The container body includes a body portion with a relatively constant outer diameter and a varying diameter neck portion integrally connected to the body portion and terminating in an opening. The container body is constructed and arranged to receive, without crushing deformation, a metal crown applied by conventional glass bottle crowning equipment.

15 Claims, 16 Drawing Sheets

FIG. 1

(56) References Cited

OTHER PUBLICATIONS

Watkins, Evan D.; Atkinson, Michael; Hunnel, James; U.S. Appl. No. 13/948,019, filed Jul. 22, 2013 for "Container Body Forming Apparatus and Method," 27 pages.

Watkins, Evan D.; Atkinson, Michael; U.S. Appl. No. 14/042,455, filed Sep. 30, 2013 for "Metal Bottle Type Container With Insert/Outsert and Related Methodology," 41 pages.

Office Action dated Oct. 15, 2014 issued to U.S. Appl. No. 14/042,455, filed Sep. 30, 2013 for "Metal Bottle Type Container With Insert/Outsert and Related Methodology", 9 pages.

* cited by examiner

METAL BOTTLE TYPE CONTAINER AND RELATED METHODOLOGY

This application claims the benefit of U.S. Provisional Patent Application Ser. No. 61/708,517 filed Oct. 1, 2012, which is hereby incorporated by reference for all that it discloses.

RELATED APPLICATION

This application is related to U.S. patent application Ser. No. 14/042,455, of Evan D. Watkins and Michael Atkinson entitled METAL BOTTLE TYPE CONTAINER WITH INSERT/OUTSERT AND RELATED METHODOLGY, filed on the same date as the present application, now U.S. Pat. No. 9,139,324, issued Sep. 22, 2015.

BACKGROUND

It is known to form drawn, or drawn and ironed, cans from aluminum and steel for use in packaging of beer, soft drinks, oil, and other liquids and also for use as aerosol containers for a variety of products. Most metal cans for beer and beverages are adapted to be closed with relatively flat lids or ends which are secured on the cans by double seaming or the like. The lids may have tear strips formed in them and have pull tabs attached to the tear strips to facilitate forming pouring openings in the lids. It is also known to provide cans with cone top ends on them as disclosed in U.S. Pat. Nos. 4,262,815; 4,574,975; 4,793,510 and 4,911,323. It is further known to provide an easy opening container with a reduced diameter cylindrical portion on it and angular spaced thread segments on the cylindrical portion as disclosed in U.S. Pat. No. 3,844,443. That patent also discloses a method for forming such a container which includes one or more forming operations such as drawing and ironing operations.

U.S. Pat. No. 5,718,352 discloses a lightweight, drawn and ironed aluminum bottle made from thin gauge, hard temper aluminum alloy comprising a one-piece container body having a drawn and ironed sidewall with a sidewall diameter in a range of 2.5 to 3.5 inches and metal thickness in the sidewall in a range of about 0.0045 inch to 0.0065 inch, an integral bottom end wall having a metal thickness of at least about 0.010, an integral die-necked, substantially frustoconical neck portion extending upwardly from the sidewall, an integral die-necked, substantially cylindrical chimney extending upwardly from the frustoconical neck portion, a threaded sleeve around the chimney and secured thereon by an outwardly and downwardly projecting flange around the top edge of the chimney.

DETAILED DESCRIPTION

Figure 1:
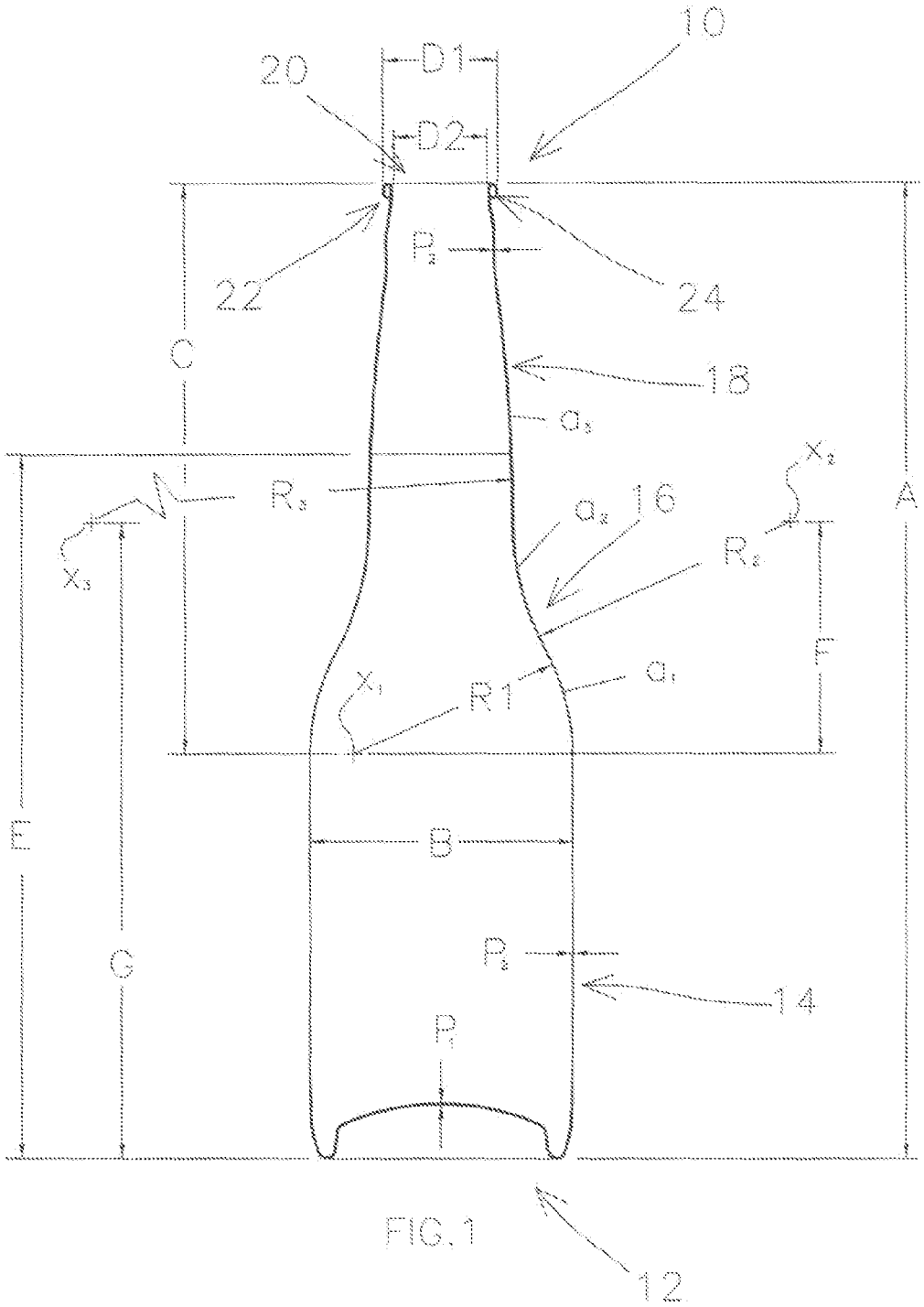
FIG. 1 is cross-sectional elevation view of a metal bottle type container having a finish area that mimics the finish area of a conventional glass bottle.

Glass beverage bottles, including beer bottles, are conventionally filled on high speed conveyor lines and are thereafter crowned on high speed conveyor lines. Crowning a bottle with a pry-off or twist-off type crown involves attaching the crown to the bottle finish area. A pry-off crown is attached by first centering it on the bottle above the opening and then crimping it over a rounded bead at the top of a bottle. Crimping force is applied by a generally cylindrical crowning head that engages a skirt portion of a crown and deforms it radially inwardly through application of axial force to the crown during downward movement of the crowning head. A twist off crown is attached in generally the same manner as a pry-off crown, except that the skirt is urged radially inwardly over twist off pseudo threads on the finish area of a bottle. Either operation requires application of considerable axial force to the bottle, e.g., 450 lb force for application of conventional steel crowns. Some impact extruded metal bottles have been crowned using conventional bottle crowning machinery.

An advantage that drawn and ironed metal bottles have over impact extruded metal bottles is that the drawn and ironed bottles may be produce with thinner walls, and thus require considerably less metal for comparably sized containers. It would be economically desirable to crown drawn and ironed metal bottles using the same crowning machinery that is used to crown glass bottles, both for reasons of production speed and for minimizing capital expenditure on new equipment. However, prior to the development of the metal bottles described herein, no drawn and ironed metal bottles had been developed that were capable of being crowned with conventional crowning machinery. This failure to develop crownable drawn and ironed metal bottles was due to certain technical difficulties associated with: 1) forming a closure ("finish") area that is of a proper form to receive a crown; 2) withstanding the axial force exerted by conventional crowning machinery applying a conventional steel crown without bottle sidewall deformation in the neck region; and 3) forming a bottom dome that can withstand the axial loading force associated with crowning and that can withstand the internal pressure associated with certain beverages, for example beer, without dome growth or inverting deformation. Applicants have overcome these problems with the drawn and ironed metal bottles described herein. Apparatus that may be used to produce such drawn and ironed metal containers are disclosed in U.S. patent application Ser. No. 13/948,019, filed Jul. 22, 2013, of Evan D. Watkins and Michael Atkinson for Container Body Forming Apparatus and Method and U.S. patent application Ser. No. 13/947,972, filed Jul. 22, 2013, of Michael Atkinson, Evan D. Watkins, Donna Kelley and James Hunnel for Container Body Trimming Apparatus and Method, U.S. patent application Ser. No. 13/215,055 filed Aug. 22, 2011 of Evan D. Watkins and Michael Atkinson for Indexing Machine with a Plurality of Work Stations, all of which are hereby incorporated by reference for all that is disclosed therein.

It may be desirable for metal bottles to be filled to approximately the same height as comparably sized glass bottles. Due to differences in wall thickness, metal and glass bottles of the same outer dimensions have significantly different volumes and would thus fill to different heights with the same volume of fluid. In at least some of applicants' metal bottle embodiments described below, the configuration of the metal bottle provides a beverage fill height comparable to that of a glass bottle of the same volume while at the same time providing a bottle capable of being crowned with conventional glass bottle crowning machinery. In the industry, container size is typically given based upon the amount of fluid filling a bottle to its fill height. That convention is used herein. Most American beverage bottles are 12 fl-oz or 16 fl-oz bottles and such bottles are described herein. Metal weight to bottle volume ratios provided herein are based upon such fill volumes ("nominal volumes") rather than the entire internal volume of the containers.

The terms "top" and "bottom" as used herein do not imply any particular orientation with respect to a gravitational field, but rather are used in a relative sense for describing the spatial relationship between the various parts of containers, generally based upon the orientation of the container shown in drawing figures or the orientation of the container that is typically assumed when people are describing a container, i.e. the opening from which liquid is poured is positioned at the "top" of the container. The surface on which the container is ordinarily supported is located at the "bottom" of the container. The terms "up," "down," "upper," "lower," "vertical," "horizontal" "lateral" and similar terms are used in the same manner. Since "top" and "bottom" are used in a relative sense, the description of the container 10 that is provided herein does not change, no matter how the container may be oriented in space, top up, top down or lying on its side.

FIG. 1 shows a container 10 which may, for example, take the form of a drawn and ironed metal bottle. The container 10 may be a 12 oz, long neck container having a base portion 12, a cylindrical body portion 14, a reduced diameter neck portion 18 and a shoulder portion 16 where the diameter transitions from the relatively larger diameter body portion 14 to the smaller diameter neck portion 18. The container 10 may also include an opening 20 formed at the termination of the neck portion 18. A closure area 22 (sometimes referred to in the industry and herein as the "finish area") may be located on the neck portion 18 adjacent the opening 20. The container 10 may be an aluminum drawn and ironed container adapted for use with carbonated beverages, such as beer and soda.

Figure 4:
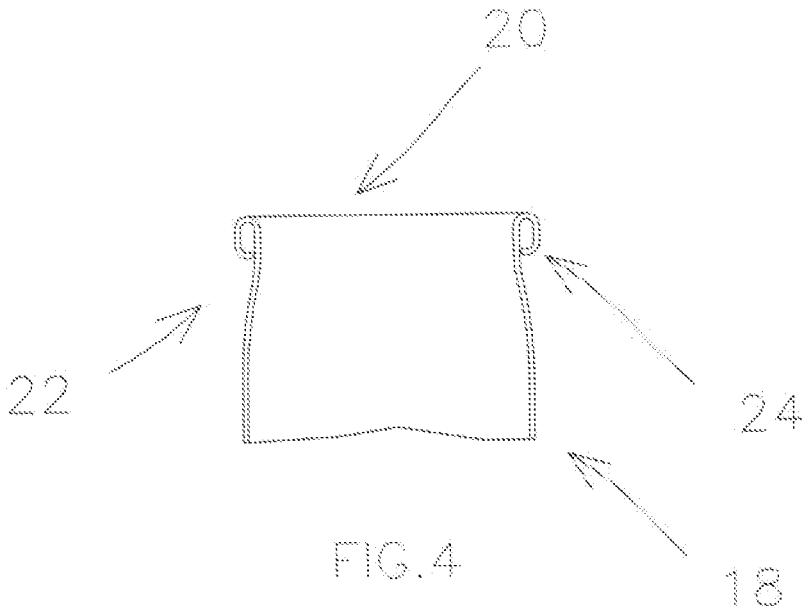
FIG. 4 is a cross-sectional detail view of the finish area of the metal bottle type container of FIG. 1.

With further reference to FIG. 1, the finish area 22 of the container 10 may be adapted to facilitate attachment of a closure member, such as a conventional steel crown (not shown in FIG. 1) after the container is filled, for example, with beer. In the exemplary embodiment of FIG. 1, the finish area 22 takes the form of a rolled curl 24 which may be integrally formed from the metal (e.g., aluminum) of the container 10. Methods and apparatus for forming such curls at the opening of a metal container are known in the art and are thus not described herein. FIG. 4 illustrates, in further detail, the upper extent of the neck portion 18, including the opening 20, finish area 22, and rolled curl 24. The rolled curl 24 is configured to accept a conventional bottle crown (i.e., a "pry-off" type of crown that is removed using a bottle opener), applied by conventional bottle crowning equipment.

With reference to FIG. 1, the container 10 may, for example, have an overall height "A" of about 9.000 in, an outside diameter "B" of about 2.400 in and a distance "C" between opening 20 and the point where the lower extent of the shoulder portion 16 meets the constant diameter cylindrical body portion 14 of about 5.3 in. The rolled curl 24 may, for example, have an outside diameter "$D_1$" of about 1.047 in and an inside diameter "$D_2$" of about 0.849 in. A detail of the finish area 22 and rolled curl 24 of the container 10 is shown in FIG. 4. Referring again to FIG. 1, after the container 10 has been filled, e.g., with a beverage, the fill height "E" may, for example, be about 6.50 in. The container 10 in the shoulder portion 16 may have a first arcuate portion "$a_1$" having a radius of curvature "$R_1$" of about 2.000 in and a center of curvature "$x_1$" at the same height as the top of the bottle body portion 14 where the annular wall thereof changes from a straight line to an arc. The length of first arcuate portion $a_1$ may be about 0.936 in. The shoulder portion 16 has a second arcuate portion "$a_2$" that has a radius of curvature "$R_2$" of about 2.500 in with a center of curvature "$x_2$" at a height F of about 2.146 in above that of point $x_1$. The length of arcuate portion $a_2$ may be about 1.232 in. The two arcuate portions $a_1$ and $a_2$ may be connected at the point where the respective arcs intersect. A third arcuate portion "$a_3$" is located in the neck portion 18 and intersects with the second curved portion $a_2$. The third arcuate portion $a_3$ may have a radius of curvature "$R_3$" of about 16.50 in. The center of curvature of arcuate portion $a_3$ may be located at a height "G" measured from the bottom of the container of about 5.867 in the length of arcuate portion $a_3$ may be about 2.295 in. The points of intersection of the various arcs may all be points of tangency of the subject arcs. The wall thickness at the center of arc $a_1$ may be about 0.0082 in. The wall thickness at the center of arc $a_2$ may be about 0.0092 in. The wall thickness at the center of arc $a_3$ may be about 0.0170 in.

Figure 1A:
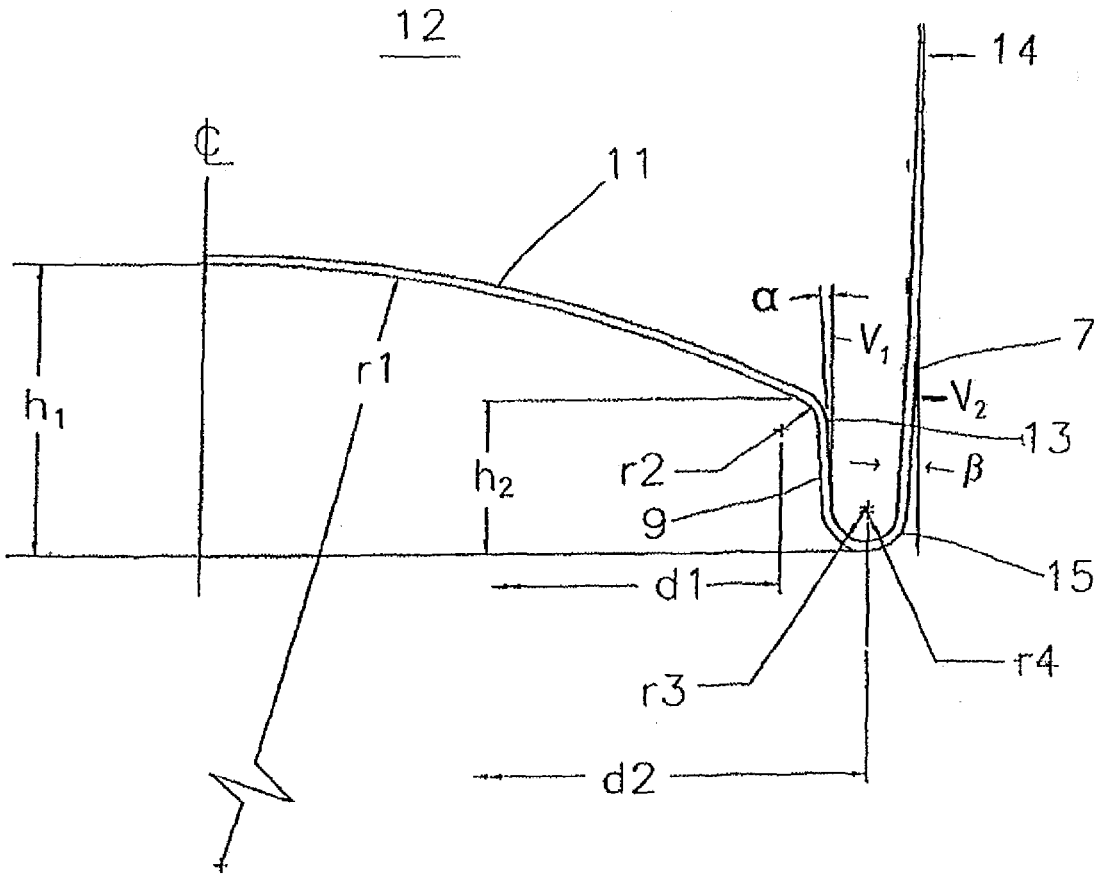
FIG. 1A is a detail cross-sectional view of a bottom portion of the container of FIG. 1.

FIG. 1A is a cross sectional detail view of one embodiment of the bottom portion 12 of container 10. The bottom portion 12 includes a central, upwardly concave dome portion 11 having a centerline CL, a height "$h_1$" above the bottom of the container of about 0.500 in and a radius of curvature "$r_1$" of about 2.200 in, and a center of curvature on the centerline CL.

The dome portion 11 transitions into an annular dome shoulder portion 13 having a radius of curvature "$r_2$" of about 0.060 in. An annular inner wall portion 9 extends downwardly and outwardly from the dome shoulder portion 13 at an angle "α" of about 3.0° from a vertical axis $V_1$. The sidewall of the container body portion 14 is parallel to central axis CL. Inner wall 9 intersects an inside wall portion of rounded foot portion 15. This inside wall portion of the rounded foot portion 15 may have a radius of curvature "$r_3$" of about 0.060 in. The inside wall portion of the rounded foot portion 15 intersects an outside wall portion of rounded foot portion 15 that has a radius of curvature "$r_4$" of about 0.060 in. The two radii $r_3$ and $r_4$ intersect along a circle having a diameter of about 2.220 in. An outer wall 7 that intersects the rounded foot portion 15 may slope downwardly and inwardly from a vertical axis $V_2$ at an angle β of about 3° starting at a point about 0.600 in above the bottom of foot portion 15. Thus, a peripheral ring around the dome wall 11 is formed by the inner wall 9, rounded foot portion 15 and outer wall 7. The substantially vertical walls 7 and 9 connected by the rounded foot portion 15, and particularly the substantially vertical outer wall 7, enable the domed bottom portion 12 to withstand the axial loading of a conventional crowning machine. The more angled and/or rounded peripheral outer wall of a conventionally domed, drawn and ironed metal can, would be crushed under such an axial load. The outer wall 7 for typical axial loading of 450 lb may be angled relative to the vertical sidewall of container body 14 at an angle β of less than about 6°. As previously mentioned, in one embodiment β is about 3°.

In the embodiment of FIG. 1, when the bottle is made from aluminum, the wall thickness of the aluminum may have approximately the following values at the indicated points and may vary progressively between those points. P1=0.0155 in, $P_2$=0.0073 in, $P_3$=0.020 in. $P_2$ may have about the minimum wall thickness and $P_3$ about the maximum wall thickness of the container 10. In one embodiment of the bottle 10 of FIG. 1, the type of aluminum used is relatively low strength, medium gage, high recycle content aluminum and the total weight of an empty container 10 is about 32.1 g for a nominal 12 fl-oz bottle. Thus, for this container, the container weight to (nominal) volume ratio "k"=2.675 g/fl-oz.

When the container 10 is configured such as described in the preceding paragraphs, it can be filled and handled by a conventional glass bottle crowning line. In this regard, for example, the walls of the container are constructed having a shape and thickness designed to withstand the axial loads imposed by conventional bottle crowning equipment without crushing deformation. The aluminum in the finish area must also be sufficiently thick to withstand the significant amount of metal working forces needed to form the curl 24. The configuration and wall thickness of the domed bottom portion 12 can withstand and internal pressure of about 95 psi without dome growth or inversion.

Figure 2:
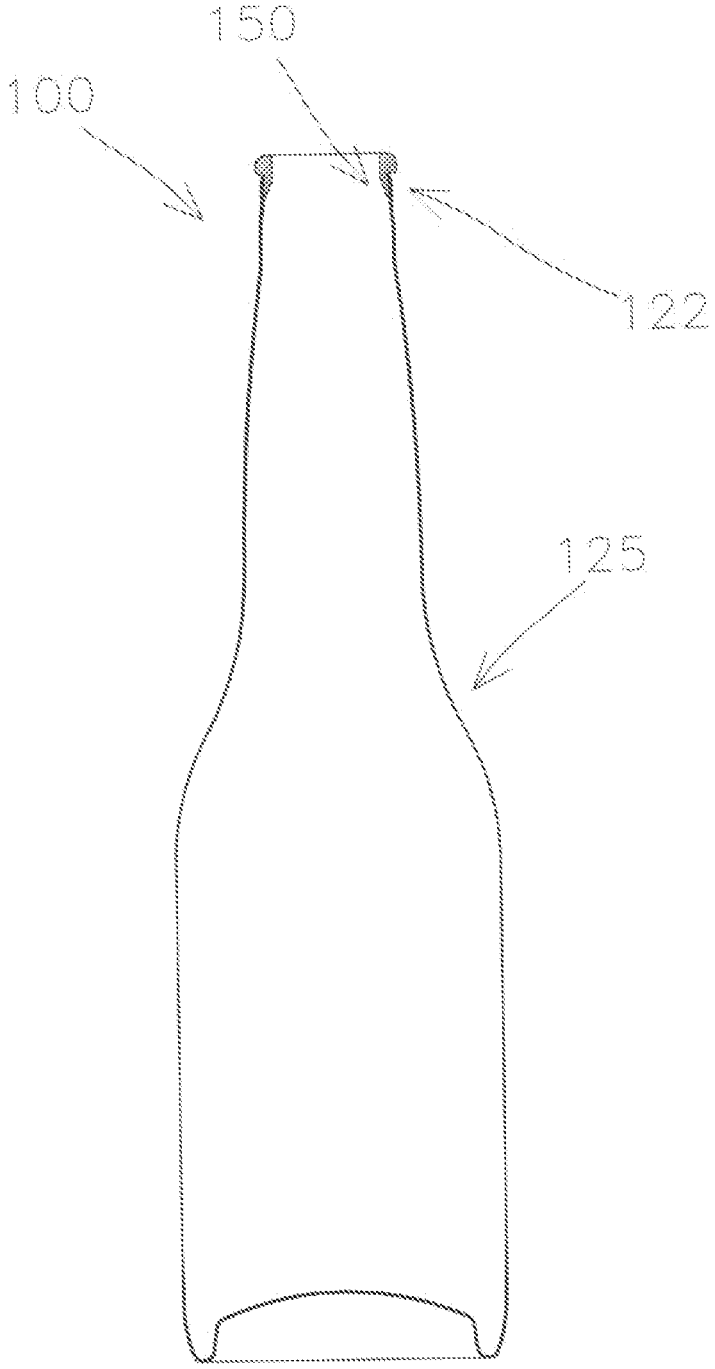
FIG. 2 is a cross-sectional elevation view of a metal bottle type container having an insert that mimics the finish area of a conventional glass bottle.
Figure 5:
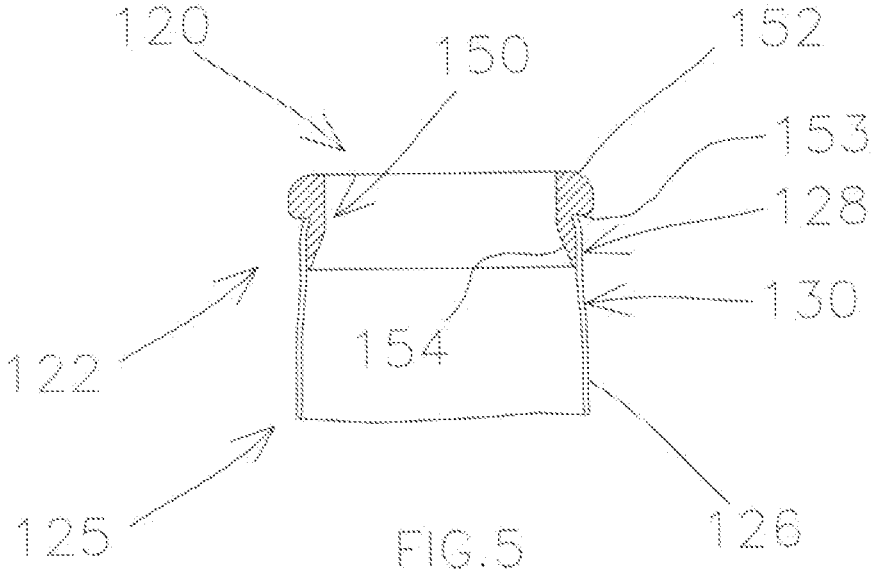
FIG. 5 is a cross-sectional detail view of the finish area of the metal bottle type container of FIG. 2, including the insert.

FIG. 2 illustrates an alternative metal container 100. The container 100 may, for example, be substantially identical to the previously described container 10 of FIG. 1, except that the finish area 122 of the container 100 may be formed differently. FIG. 5 illustrates the finish area 122 of the container 100 in further detail. With reference now to FIG. 5, it can be seen that the body portion 125 of the container 100 may include an annular wall 126 having an outwardly flared portion 128 adjacent the opening 120. A transition portion 130 of the wall 126 is formed where the diameter of the body portion 125 expands into the flared portion 128.

With further reference to FIG. 5, an insert 150 having an annular bottom edge 151 and an annular rounded top edge 123 may be attached to the body portion 125 of the container 100, as shown. (As used herein, the term "insert" refers to a ring that is positioned at least partially inside the subject container body. "Outsert" refers to a ring positioned outside the container body.) The insert 150 may, for example, be formed from plastic and may include a head portion 152 and an integrally formed tail portion 154. The head portion 152 may be configured to mimic the finish area found on a conventional glass bottle and may, for example, have substantially the same outer size and shape as the rolled curl 24 described previously herein with respect to the bottle 10 of FIGS. 1 and 4. In this manner, the head portion 152 with a step transition 153 to the tail portion 154 is adapted to sealingly accept a conventional bottle crown, (i.e., the type of crown that is removed using a bottle opener), applied by conventional bottle crowning equipment. Contact between the upper surface of the head portion 152 and the crown forms a seal.

With continued reference to FIG. 5, the tail portion 154 of the insert 150 may have a reduced outer diameter relative to the head portion 152 and may extend into the container flared portion 128, as shown. The insert 150 may be held in place relative to the container body portion 125, for example, by a suitable adhesive. Alternatively, the insert 150 may be attached by first heating the container body portion 125 to a temperature equal to or greater than the melting temperature of the plastic from which the insert 150 is formed. After heating, the tail portion 154 of the insert 150 may be inserted into the flared portion 128 of the body portion 125. The heat of the body portion 125 causes the plastic insert 150 to partially melt. As the body portion 125 cools, the plastic solidifies, thus bonding the insert 150 to the body portion 125. Also, upon cooling, the metal (e.g., aluminum) forming the body portion 125 will contract, thereby gripping the insert 150 to further strengthen the attachment.

Use of the insert 150, as described above, is advantageous relative to the rolled curl 24 of FIGS. 1 and 2, because it allows less metal to be used in the neck portion of the bottle 100. Specifically, to form the rolled curl 24 of FIGS. 1 and 4, the wall of the container 10 must be formed having a substantial thickness in order to withstand the significant amount of metal working forces needed to form the curl. Further, the container 10 may have to be formed from a more ductile metal in order to withstand the stresses and work hardening involved. Since the insert 150 eliminates the need to form a curl from the metal of the container, a significant amount of metal can be eliminated from the container 100, relative to the container 10. In one embodiment, for a 12 oz long neck aluminum bottle the wall thickness in the finish area may be about 0.012 in and the total aluminum weight of the container 100 may be about 26.0 g and the ratio k may be about 2.167 g/fl-oz.

Figure 3:
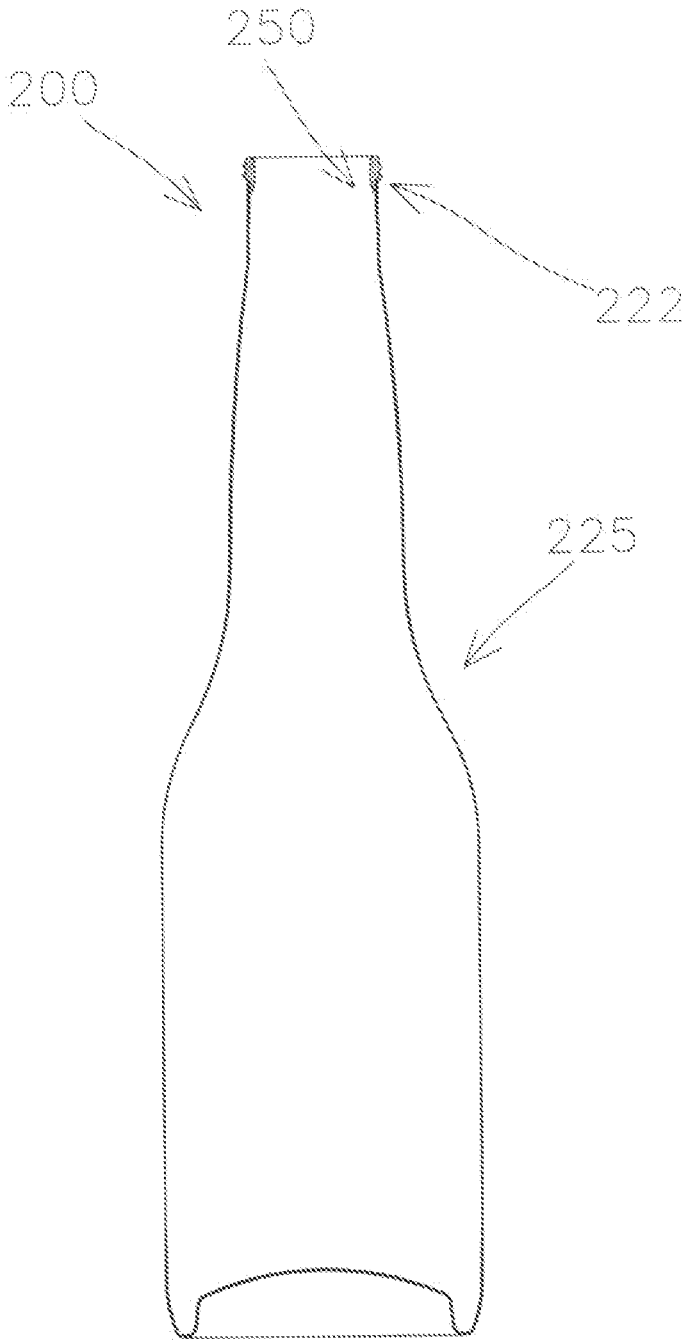
FIG. 3 is a cross-sectional elevation view of a metal bottle type container having an insert that mimics a finish area of a conventional twist-off crown type glass bottle.
Figure 6:
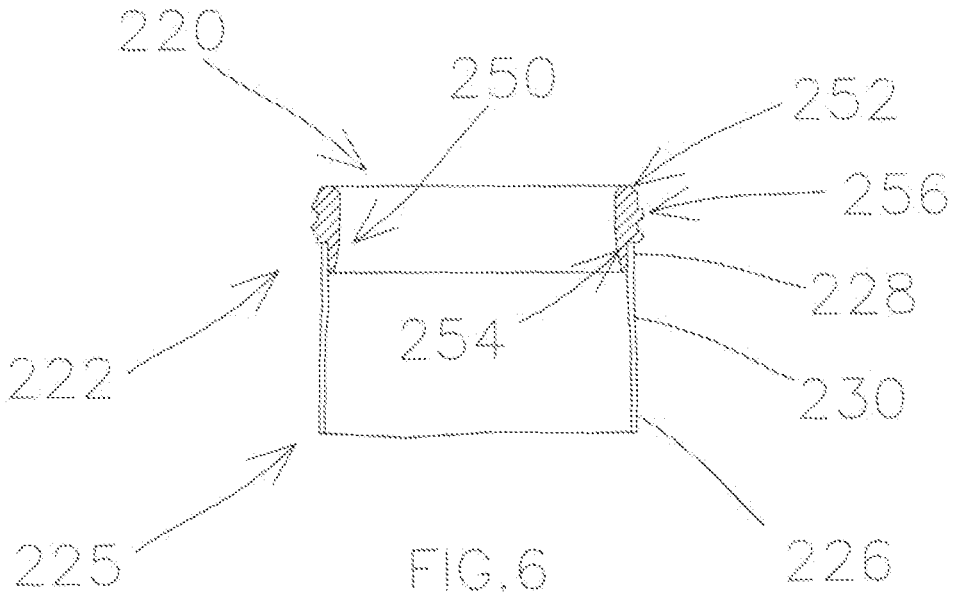
FIG. 6 is a cross-sectional detail view of the finish area of the metal bottle type container of FIG. 3, including the insert.

FIG. 3 illustrates another alternative metal container 200. The container 200 may, for example, be substantially identical to the previously described containers 10 or 100, except that the finish area 222 of the container 200 may be differently configured. FIG. 6 illustrates the finish area 222 of the container 200 in further detail. With reference now to FIG. 6, it can be seen that the body portion 225 of the container 200 may include a wall 226 having an outwardly flared portion 228 adjacent the opening 220. A transition portion 230 of the wall 226 is formed where the diameter of the container 200 expands into the flared portion 228.

With further reference to FIG. 6, an insert 250 may be attached to the body portion 225 of the container 200, as shown. The insert 250 may, for example, be formed from plastic and may include a head portion 252 and an integrally formed tail portion 254. The head portion 252 may include an external profile 256 that is configured to mimic the finish area found on a conventional "twist-off" type glass bottle. In this manner, the insert 250 is configured to accept a conventional twist-off bottle crown, applied by conventional bottle crowning equipment.

The tail portion 254 of the insert 250 may have a reduced diameter relative to the head portion 252 and may extend into the container flared portion 228, as shown. The insert 250 may be held in place relative to the container body portion 225, for example, by a suitable adhesive. Alternatively, in a manner similar to the insert 150 described previously, the insert 250 may be attached by first heating the container body portion 225. After heating, the tail portion 254 of the insert 250 may be inserted into the flared portion 228 of the body portion. The heat of the body portion 225 causes the plastic insert 250 to partially melt. As the body portion 225 cools, the plastic solidifies, thus bonding the insert 250 to the body portion 225. Further, upon cooling, the metal (e.g., aluminum) forming the body portion 225 will contract, thereby gripping the insert 250 to further strengthen the attachment.

Again, use of the insert 250, as described above, is advantageous in that it allows less metal (and a less expensive material) to be used relative to that required for a metal container having an integrally-formed twist-off crown type profile. In one embodiment, for a 12 oz long neck aluminum bottle the wall thickness in the finish area may be about 0.012 in and the total aluminum weight of the container 100 may be about 26.0 g and the ratio k may be about 2.167 g/fl-oz.

Figure 7:
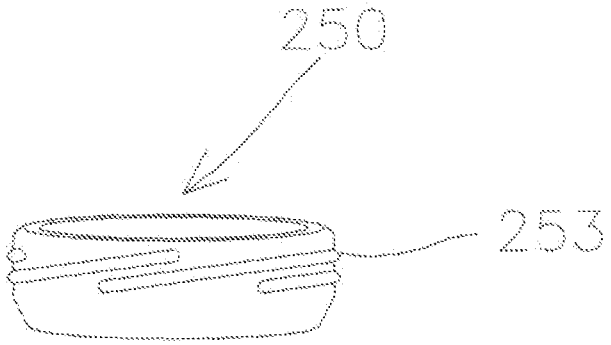
FIG. 7 is an isometric view of the twist-off crown type insert of FIGS. 3 and 6.

FIG. 7 is a three dimensional rendering of the plastic insert of FIG. 6, showing the configuration that mimics the finish area of a conventional twist-off type glass bottle. The insert 250 has a conventional twist off type thread pattern 253.

Figure 8:
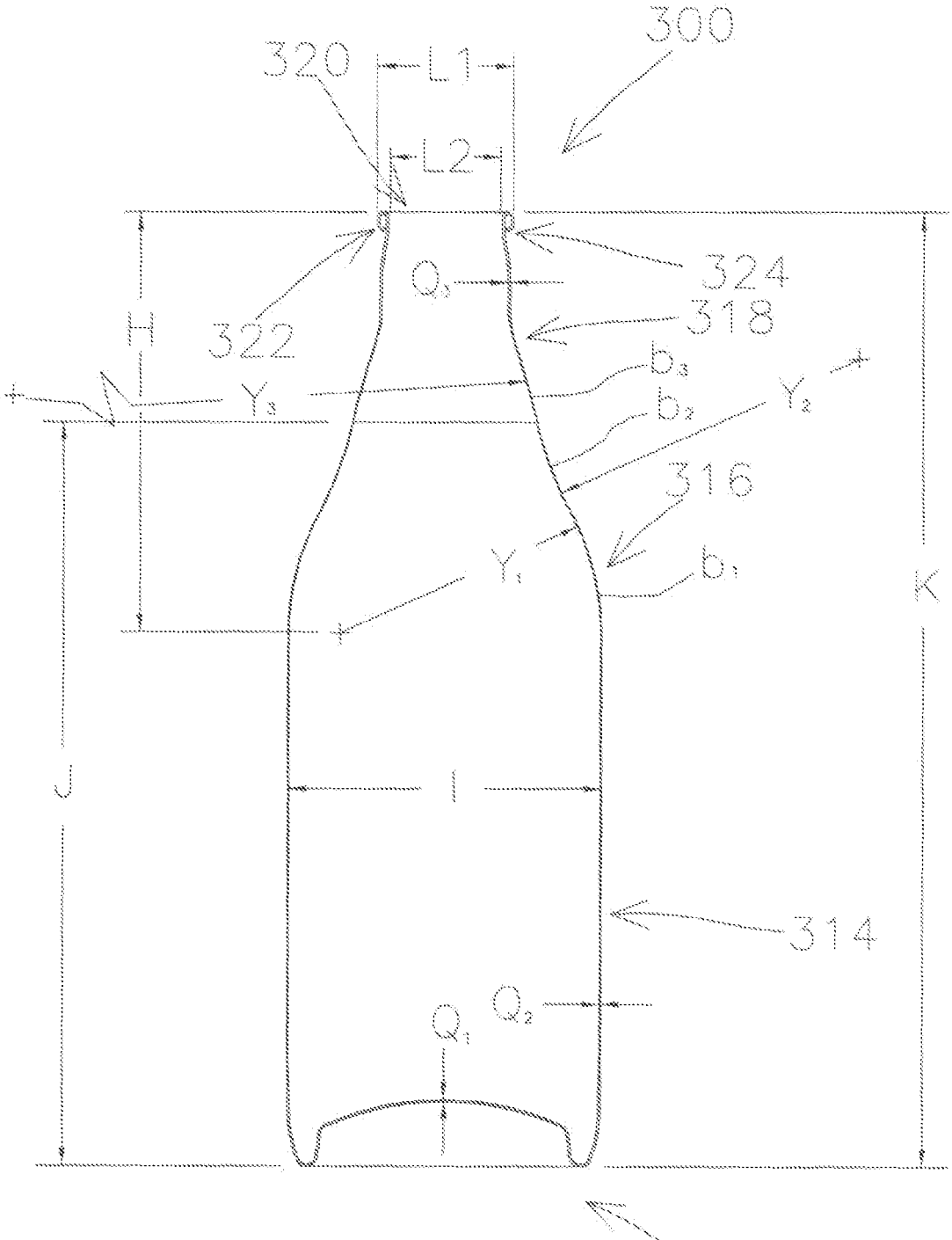
FIG. 8 is a cross-sectional elevation view of an alternate metal bottle type container having a finish area that mimics the finish area of a conventional glass bottle.

FIG. 8 shows an alternative metal bottle type container 300, which is similar to the container 10 described previously herein, except that it is provided in a short neck configuration instead of a long neck configuration. The container 300 may have a base portion 312, a cylindrical body portion 314, a reduced diameter neck portion 318 and a shoulder portion 316 where the diameter transitions from the relatively larger diameter body portion 314 to the smaller diameter neck portion 318. The container 300 may also include an opening 320 formed at the termination of the neck portion 318. A closure area 322 (sometimes referred to in the industry and herein as the "finish") may be located on the neck portion 318 adjacent the opening 320. In one embodiment, the container 300 may be a 12 oz, short neck aluminum drawn and ironed container adapted for use with carbonated beverages.

With further reference to FIG. 8, the finish area 322 of the container 300 may be provided to facilitate attachment of a closure member, not shown, after the container is filled, for example, with a beverage. In the exemplary embodiment of FIG. 8, the finish area 322 takes the form of a rolled curl 324 which may be integrally formed from the metal (e.g., aluminum) forming the container 10. The rolled curl 324 of the container 300 may be substantially identical to the rolled curl 24 of the previously described container 10 (FIGS. 1 and 4).

As can be seen from a comparison of FIGS. 1 and 8, the container 300 has a different profile relative to the previously described container 10. With reference to FIG. 8, the container 300 may, for example, have an overall height "K" of about 7.400 in, an outside diameter "I" of about 2.400 in and a distance "H" between opening 320 and the lower extent of the shoulder portion 316 of about 3.3 in. The rolled curl 24 may, for example, have an outside diameter "L" of about 1.047 in. After the container has been filled, e.g., with a beverage, the fill height "J" may, for example, be about 5.56 in. The container The neck portion 318 may comprise annular arcuate portions $b_1$, $b_2$, $b_3$, with corresponding radii of curvature $y_1$, $y_2$, $y_3$. The arc $b_1$ may have a radius of curvature $Y_1$ of about 2.000 in and an arc length of about 0.984 in. The wall thickness at the center of arc $b_1$ may be about 0.0082 in. The arc $b_2$ may have a radius of curvature $Y_2$ of about 2.500 in and an arc length of about 0.656 in. The wall thickness at the center of arc $b_2$ may be about 0.0092 in. The arc $b_3$ may have a radius of curvature $Y_3$ of about 10.000 in and an arc length of about 0.792 in. The wall thickness at the center of arc $b_3$ may be about 0.0170 in. In the embodiment of FIG. 8, where the bottle is may from aluminum, the wall thickness of the aluminum may have approximately the following values at the indicated points and may vary progressively between those points. $Q_1$=0.0155; $Q_2$=0.0072 in; $Q_3$=0.020 in. In one embodiment of the bottle 300 of FIG. 8, the total weight of an empty container 300 is about 27.5 g for a nominal 12 fl-oz bottle. Thus, for this container, the container weight to volume ratio k=2.29 g/fl-oz.

Figure 9:
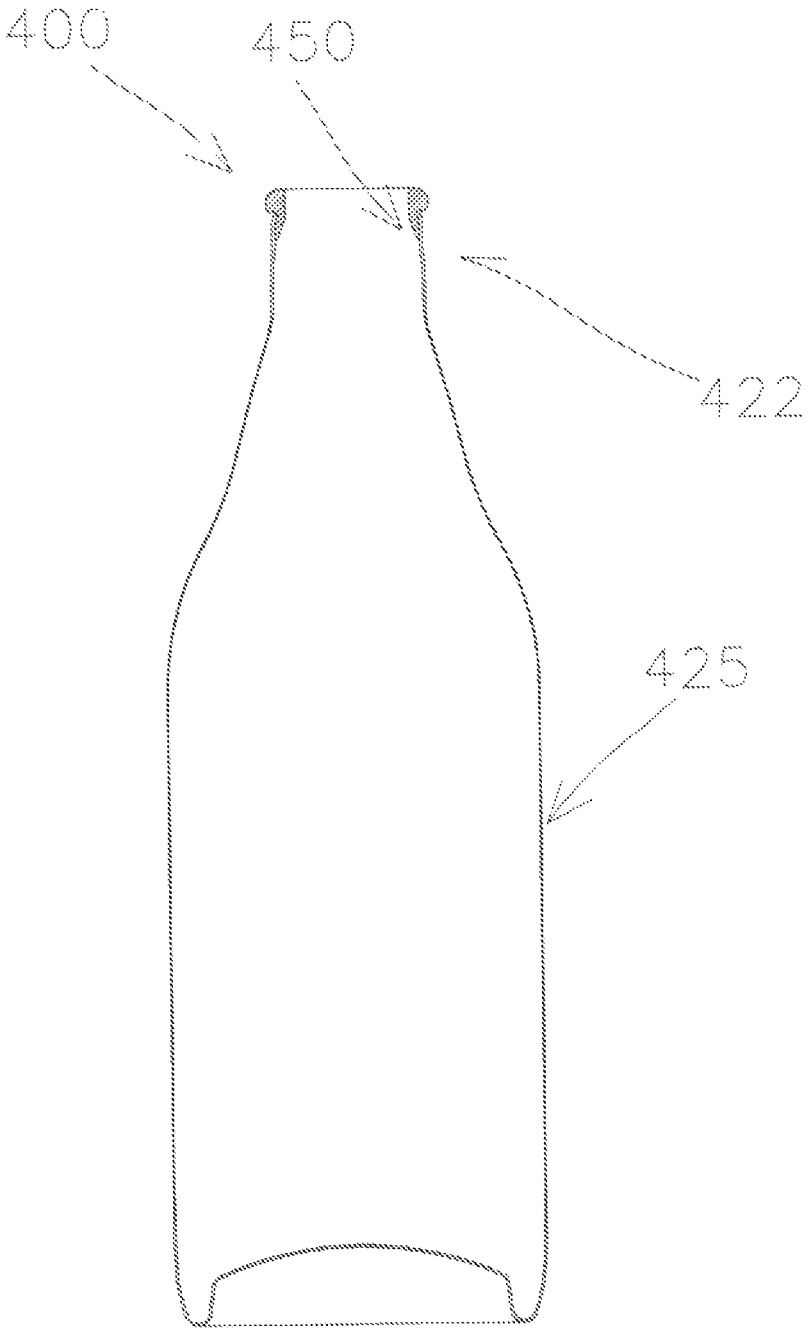
FIG. 9 is a cross-sectional elevation view of an alternate metal bottle type container having an insert that mimics the finish area of a conventional glass bottle.

FIG. 9 illustrates an alternative metal container 400. The shape of the container 400 may, for example, be substantially identical to the previously described container 300, except that wall thicknesses may be less and the finish area 422 of the container 400 may be formed differently. Specifically, an insert 450 may be attached to the container 400, as shown. The insert 450 may, for example, be substantially identical to the insert 150 previously described with respect to FIGS. 3 and 6 and the container body portion 425 may include a flared portion similar to the flared portion 128. FIG. 5, to facilitate attachment of the insert 450. The insert 450 may be secured to the body member 425, for example, by the same methods described previously with respect to the container 100 and insert 150, i.e., by the use of an adhesive or by heating the container body portion 425. In one embodiment, the wall thicknesses of container 400 of FIG. 9, with reference to the regions identified in FIG. 8, for an aluminum bottle may be as follows. The arc $b_1$ may have a radius of curvature $Y_1$ of about 2.000 in and an arc length of about 0.984 in. The wall thickness at the center of arc $b_1$ may be about 0.0078 in. The arc $b_2$ may have a radius of curvature $Y_2$ of about 2.500 in and an arc length of about 0.656 in. The wall thickness at the center of arc $b_2$ may be about 0.0088 in. The arc $b_3$ may have a radius of curvature $Y_3$ of about 10.000 in and an arc length of about 0.792 in. The wall thickness at the center of arc $b_3$ may be about 0.0130 in. In one embodiment of the bottle 400 of FIG. 9, the total weight of an empty container 400 is about 27.5 g for a nominal 12 fl-oz bottle. Thus, for this container 400, the container weight to volume ratio k=2.29 g/fl-oz.

Figure 10:
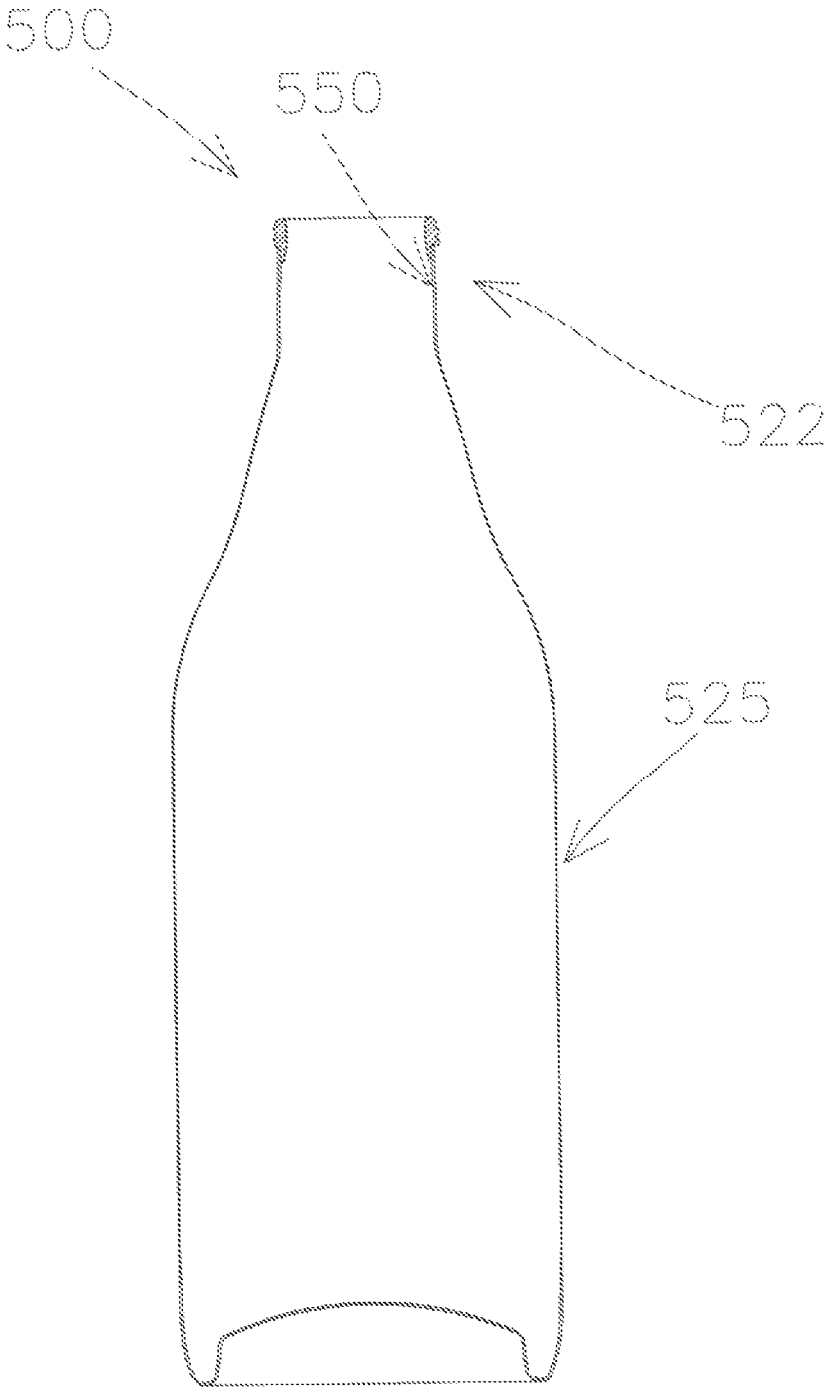
FIG. 10 is a cross-sectional elevation view of an alternate metal bottle type container having an insert that mimics the finish area of a conventional twist-off crown type glass bottle.

FIG. 10 illustrates a further alternative metal container 500. The container 500 may, for example, be substantially identical to the previously described containers 300 and 400 (FIGS. 8 and 9, respectively), except that the finish area 522 of the container 500 may be formed differently. Specifically, an insert 550 may be attached to the container 500, as shown. The insert 550 may, for example, be substantially identical to the insert 250 previously described with respect to FIGS. 3 and 6 and the container body portion 525 may include a flared portion similar to the flared portion 228, FIG. 6, to facilitate attachment of the insert 550. The insert 550 may be secured to the body member 525, for example, by the same methods described previously with respect to the container 200 and insert 250, i.e., by the use of an adhesive or by heating the container body portion 525.

Figure 11:
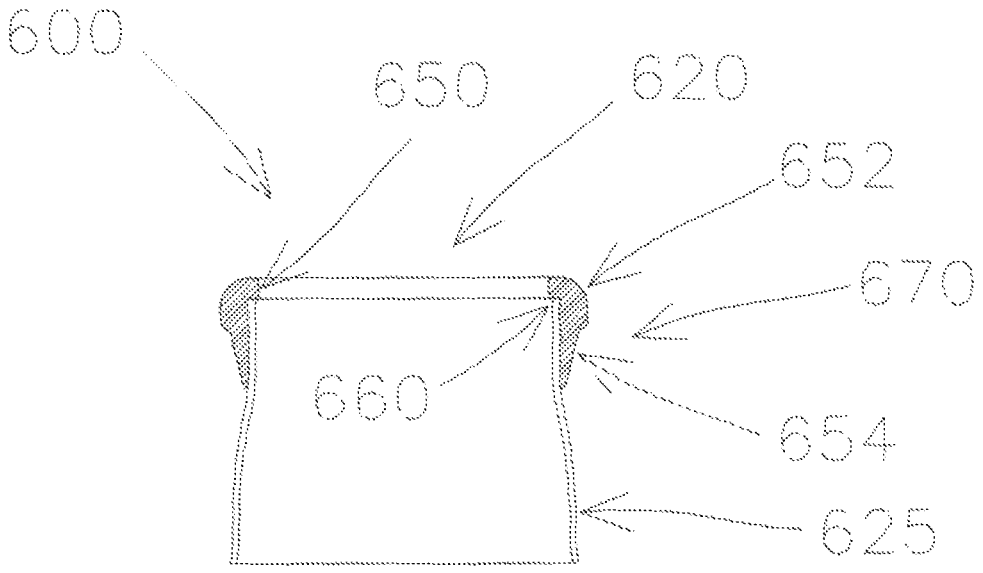
FIG. 11 is a cross-sectional detail view of a metal bottle type container having an outsert that mimics the finish area of a conventional glass bottle.

FIG. 11 illustrates an "outsert" 650 attached to the body portion 625 of a metal body type container 600. The outsert 650 may be similar to the insert 150 (previously described with respect to FIGS. 3 and 6) in that the outsert 650 may be formed of plastic and includes an outer profile 670 that mimics the finish area found on a conventional glass bottle. The outer profile 670 of the outsert 650 may, for example, have substantially the same outer size and shape as the rolled curl 24 described previously herein with respect to the bottle 10 of FIGS. 1 and 4. In this manner, the outsert 650 is configured to accept a conventional bottle crown (i.e., the type of crown that is removed using a bottle opener), applied by conventional bottle crowning equipment. In one embodiment, the type of aluminum used and the wall thicknesses and weight to volume ratio may be substantially the same as for the container 400 of FIG. 9.

With further reference to FIG. 11, the outsert 650 may include a head portion 652 and an integrally formed tail portion 654. The tail portion 654 may attach to the outer diameter of the container body portion 625 adjacent the opening 620, as shown in FIG. 11. The outsert 650 may further include an overhang portion 660 which abuts the upper edge 623 of the container body 625 serving to accurately locate the outsert 650 relative to the container body portion 625. The outsert 650 may be held in place relative to the container body portion 625, for example, by the same methods described previously with respect to the insert 150, i.e., by the use of an adhesive or by heating the container body portion 625. In one embodiment of a bottle using this outsert 650, the bottle configuration and the type of aluminum used and the wall thicknesses and weight to volume ratio may be about the same as for the container 400 of FIG. 9.

Figure 12:
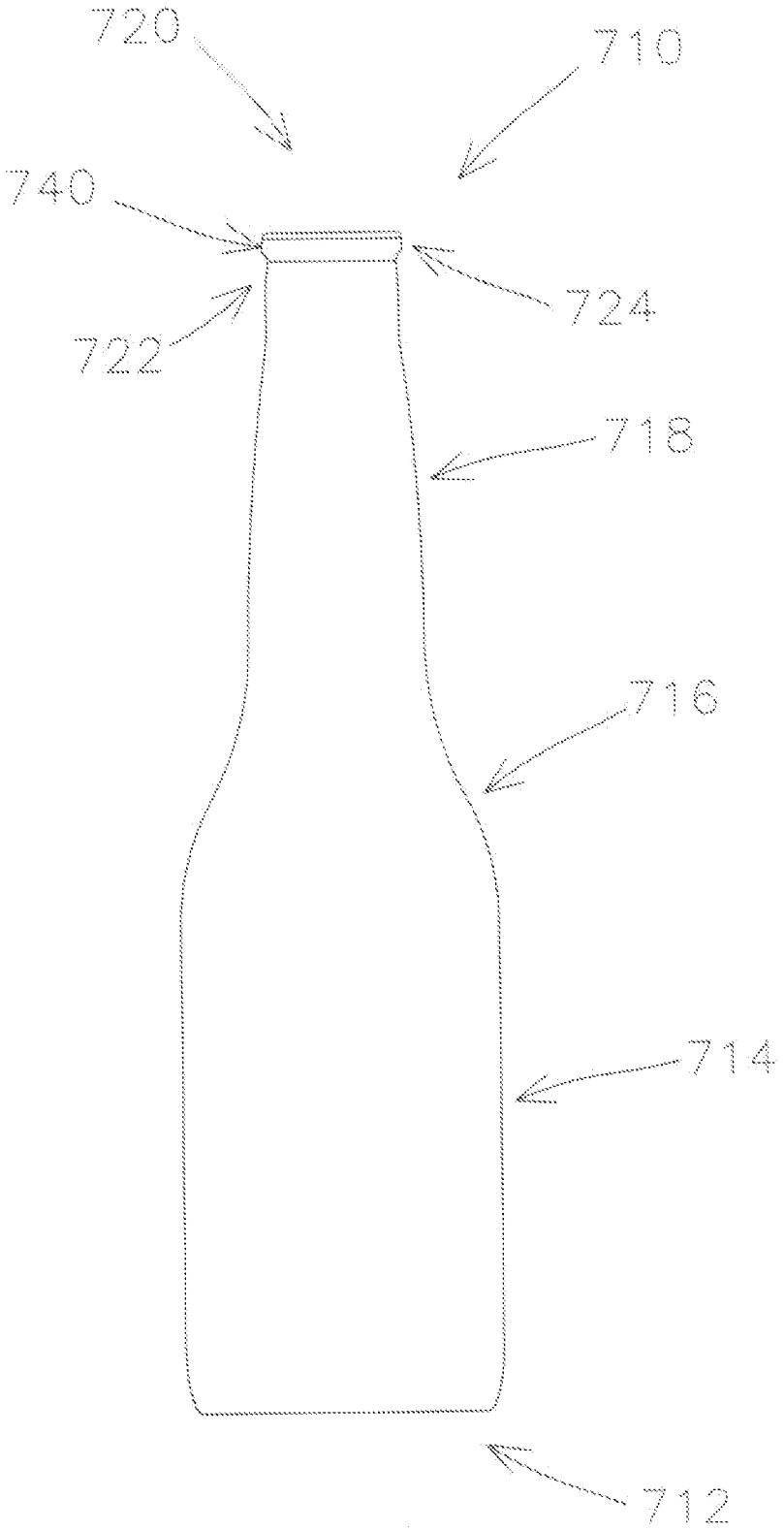
FIG. 12 is a side elevation view of a long neck metal bottle type container having an outsert that mimics the finish area of a conventional glass bottle.

FIG. 12 is a cross-sectional elevation view of another metal bottle type container 710 having a finish area that mimics the curl area of a conventional glass bottle. FIG. 12 shows a container 710 which may, for example, take the form of a drawn and ironed metal bottle. The container 710 may have a base portion 712, a cylindrical body portion 14, a reduced diameter neck portion 18 and a shoulder portion 16 where the diameter transitions from the relatively larger diameter body portion 14 to the smaller diameter neck portion 18. The container 10 may also include an opening 20 formed at the termination of the neck portion 18. A closure area 22 (sometimes referred to in the industry and herein as the "finish area") may be located on the neck portion 18 adjacent the opening 20. The container 10 may be an aluminum drawn and ironed container adapted for use with beverages. The various bottle dimensions and, curvature, except in the finish area 722 and except for wall thickness, may be the same or substantially the same as for container 10. The wall thicknesses of the container 710, with reference to the same regions as shown in FIG. 1, may be as follows: The wall thickness at the center of arc $a_1$ may be about 0.0078 in. The wall thickness at the center of arc $a_2$ may be about 0.0088 in. The wall thickness at the center of arc $a_3$ may be about 0.0130 in.

Figure 13:
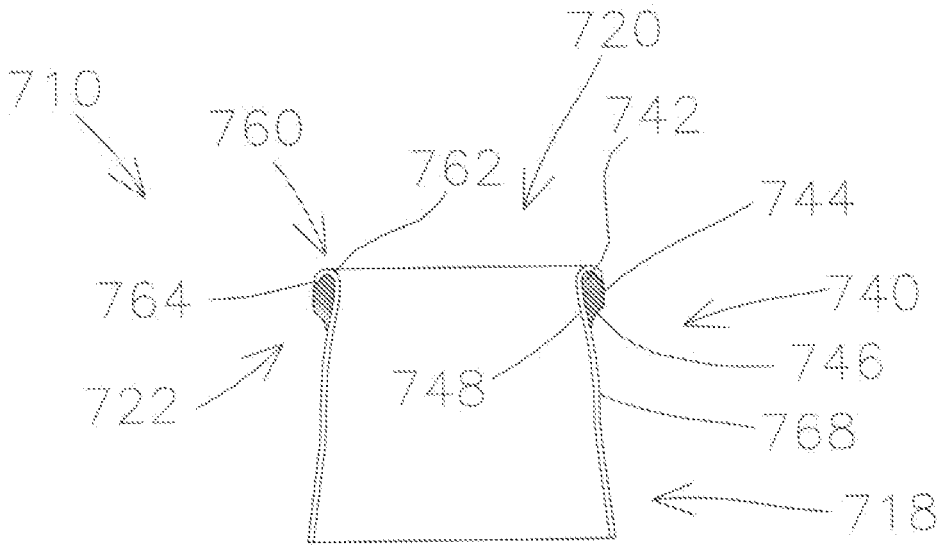
FIG. 13 is a cross sectional detail of the finish area of the metal bottle type container of FIG. 12.
Figure 14:
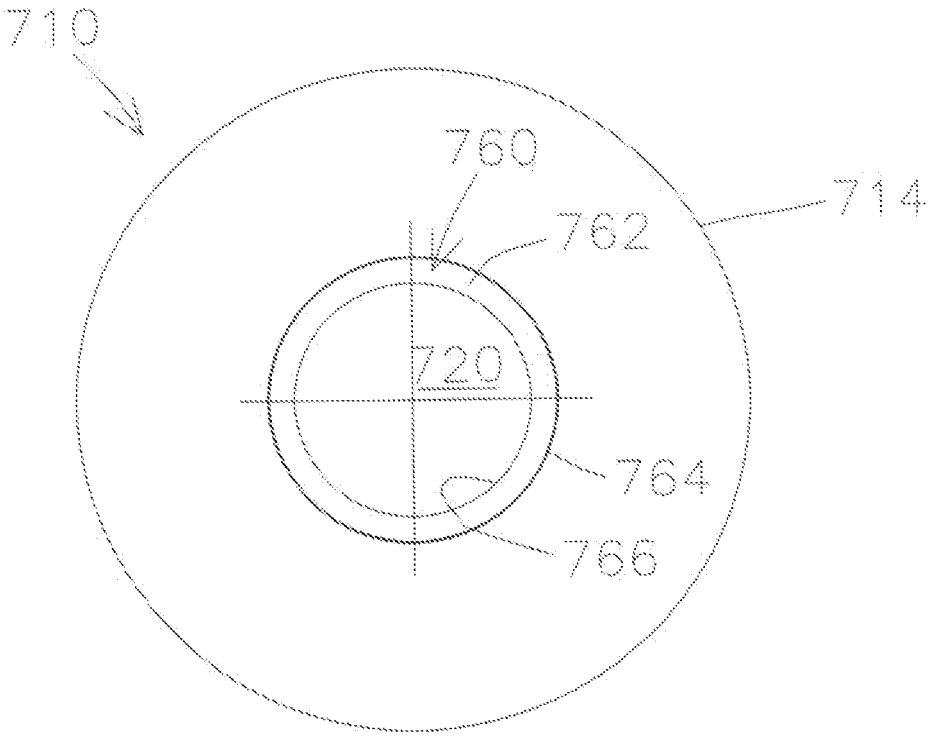
FIG. 14 is a top plan view of the metal bottle type container of FIG. 12.
Figure 15:
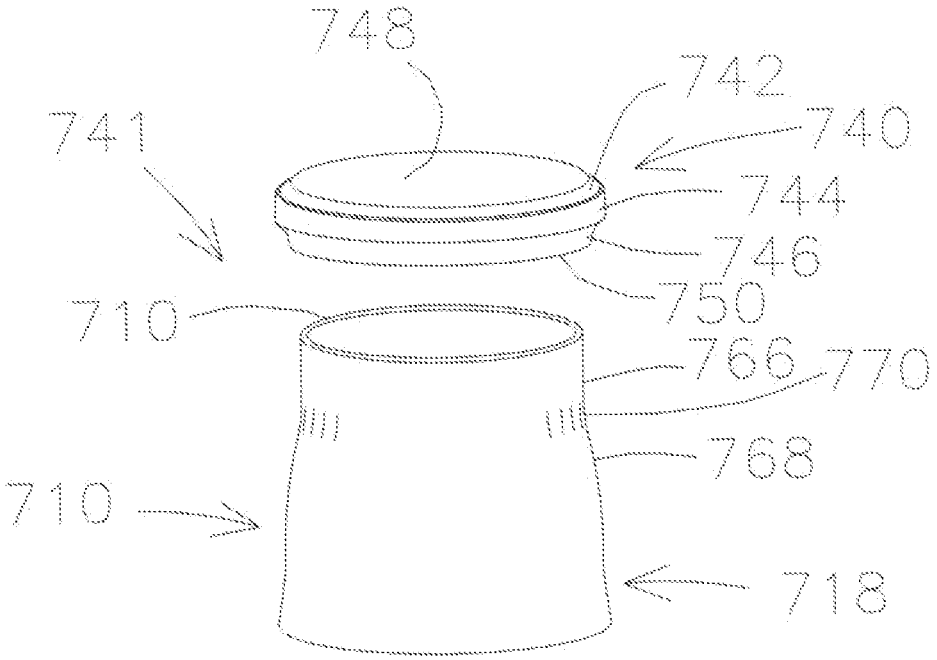
FIG. 15 is a side elevation view of a neck portion of the metal bottle type container of FIG. 12 and a plastic ring prior to the mounting of the plastic ring on the neck portion.

With reference to FIGS. 12-14, an outsert ring 740 may encompass a portion of the metal bottle finish area 722. As best shown by FIGS. 13-15, the outsert ring 740 comprises a rounded upper surface portion 742; a flat sided outer middle surface portion 744; an arcuate outer lower portion 746; a generally flat, slightly downwardly and outwardly tapering inner wall surface portion 448; and a thin bottom edge 750.

As best shown in FIGS. 13-16, the metal container 710 may have a curled metal portion 760 with a generally candy cane shaped cross section. The curled metal portion 760 comprises an upper curved portion 762 conforming to the shape of upper surface portion 744 of the outsert ring 740. It includes a terminal end 764 that if radially flush with ring surface portion 744, and a lower generally straight portion that conforms with ring surface 748. There is an outer surface bulge 768 in the neck portion 718 immediately below candy cane shaped curled metal portion 760, which begins at transition region 770. The outer diameter "Z" of the container neck portion 718 at the transition region 770 may be approximately the same as the maximum inner diameter of the ring. The outer diameter "Y" thereof is measured at a point alighted with top of the ring inner flat surface portion 748 and may be approximately the same as the minimum inner diameter of the ring 740.

Figure 16:
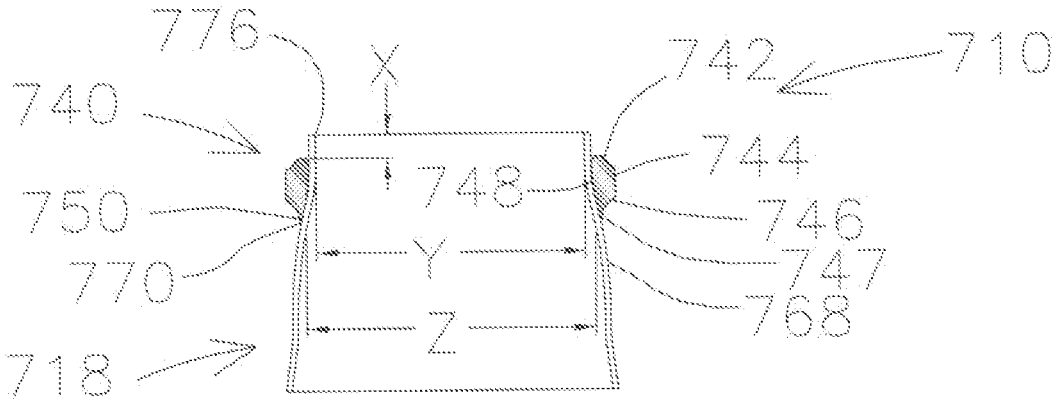
FIG. 16 is a side elevation view of a neck portion of the metal bottle type container of FIG. 12 and a plastic ring mounted on the neck portion, prior to curling deformation of the bottle sidewall.

As shown by FIG. 15, to mount the ring 740 on the container 710 the ring 740 is initially positioned axially opposite an uncurled circular top edge portion 716 of the container body. The ring 740 is mounted around the container neck portion by moving it in axial direction 741, as by use of a pick and place machine. As shown by FIG. 16, after the ring 740 has been initially mounted on the container 710 and moved into proper axial position with the bottom edge 750 of the ring located approximately at 770, a small axial length "X" of the neck portion extends above the top edge of the ring 740. This axially upwardly extending portion of the neck positioned above the ring 740 is then curled over by a conventional curling apparatus to place it in the position shown in FIG. 13. The inner diameter Y of the ring 740 at its upper most point of contact with the container 710 may be about equal to the outer diameter of the opening of the container 710 and the inner diameter Z of the ring 740 at its lower most point of contact with the container 710 may be about the same as the inner diameter of the container sidewall at an axial position 770 about midway down the flared portion. The metal curl 760 and the enlarged diameter of 768 maintained the ring 740 in a fixed axial position on the neck portion 718.

In the embodiment of the container 710 of FIGS. 12-14, when the bottle is made from aluminum, the bottle curvature and length and diameter dimensions may be the same as in FIG. 1 except in the finish area 722, as previously described. As previously mentioned, the wall thickness of the aluminum may be substantially less in container 710 than in the container 10 of FIG. 1. In one embodiment of the bottle 710 of FIG. 12, the total weight of an empty container 710 is about 26.0 g as opposed to about 32.1 g for container 10. Thus, as a result of using outsert 750 rather than relying entirely on a curled metal portion such as 24 in FIG. 1 to provide the structure for receiving a pry-off crown, less aluminum could be used without adverse consequences.

When an aluminum drawn and ironed container 710 is configured such as described in the above paragraph, it can be filled and handled by a conventional glass bottle filling line. In this regard, for example, the walls of the container are constructed having a shape and thickness designed to withstand the axial loads imposed by conventional bottle crowning equipment. Also the material from which the container 710 is constructed may be a thinner material than the material needed for the metal container 10 of FIG. 1. One reason for this is that with the plastic outsert mounted on the container 710 provides part of the crown mounting structure (curl) and thus less metal is needed to form the crown mounting structure. Also, the outsert ring adds support to the sidewall of the container 720 in the finish area 722. Thus, in the finish area of container 710, the metal may be thinner and slightly shorter in axial length than in a container 10 with a curl formed entirely from the metal of the container wall. A further advantage is that a crown mounted on the container 710 makes sealing contact with the metal of the container 710 rather than the plastic outsert.

Figure 17:
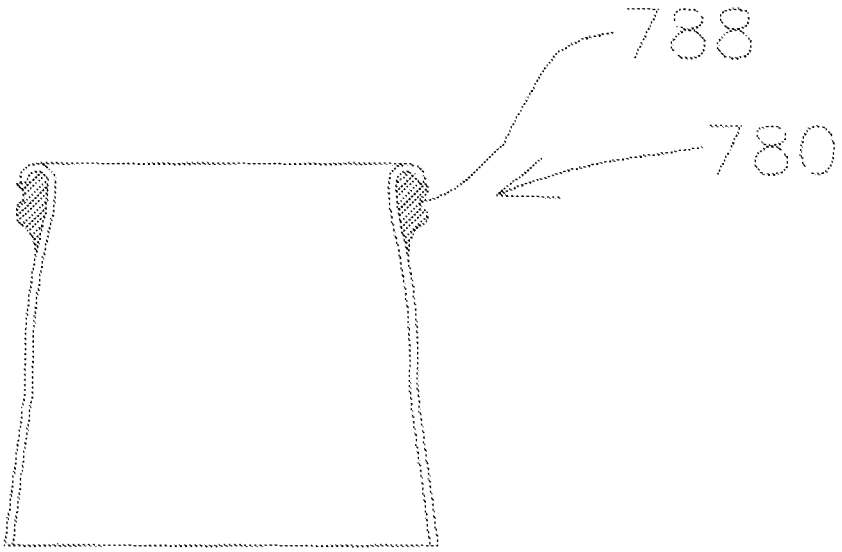
FIG. 17 is a side elevation view of a neck portion of the metal bottle type container of FIG. 12 with a twist off type plastic outsert ring mounted thereon and with the bottle top edge portion curled over the outsert ring.

An alternative ring 780 for use with a twist-off crown is illustrated in FIG. 17. The configuration of ring 780 is essentially identical to ring 740, except that rather than a straight outer middle wall surface a twist off pseudo thread surface is provided. The advantage of the container 710 on which outsert 780 is mounted are the same as described in the preceding paragraph.

Figure 18:
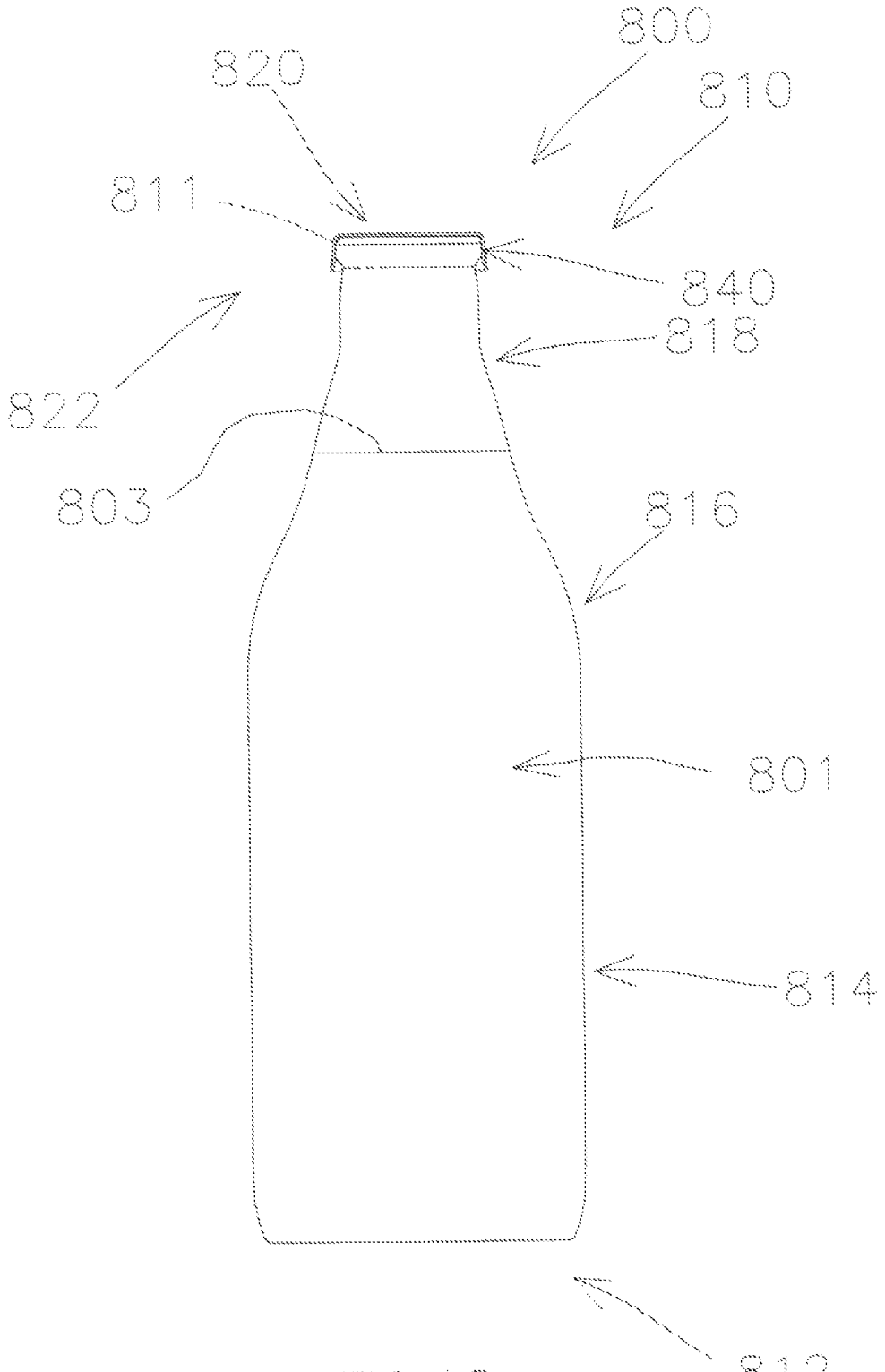
FIG. 18 is a cross sectional view of a filled and crowned metal bottle type container of the shape shown generally in FIG. 3, but which has an outsert that mimics the finish area of a conventional glass bottle.

FIG. 18 is a cross sectional elevation view of a 12 oz, short neck filled container package 800. The container package includes a container 810 that may have the same size and shape as container 300 of FIG. 8, except for differences in container wall thickness and the configuration of the finish area 822, which may be as described in FIGS. 9-11. In one embodiment the finish area 822 may be identical to the finish area described in FIGS. 12-14 for pry-off crowns or the finish area may be identical to the finish area described in FIG. 17 for twist-off crowns. The finish area may be provided with a ring outsert 840 which may be identical to outsert 740 described above with reference to FIGS. 12-16 for pry-off crowns. In another embodiment the ring outsert may be identical to outsert 780 described above with reference to FIG. 17 for twist-off crowns. The container 810 shown in FIG. 18 is filled with liquid 801 to fill line 803 and is crowned, such as described generally with reference to FIG. 19 below. The crown 811 is shown in dashed lines in FIG. 19.

Figure 19:
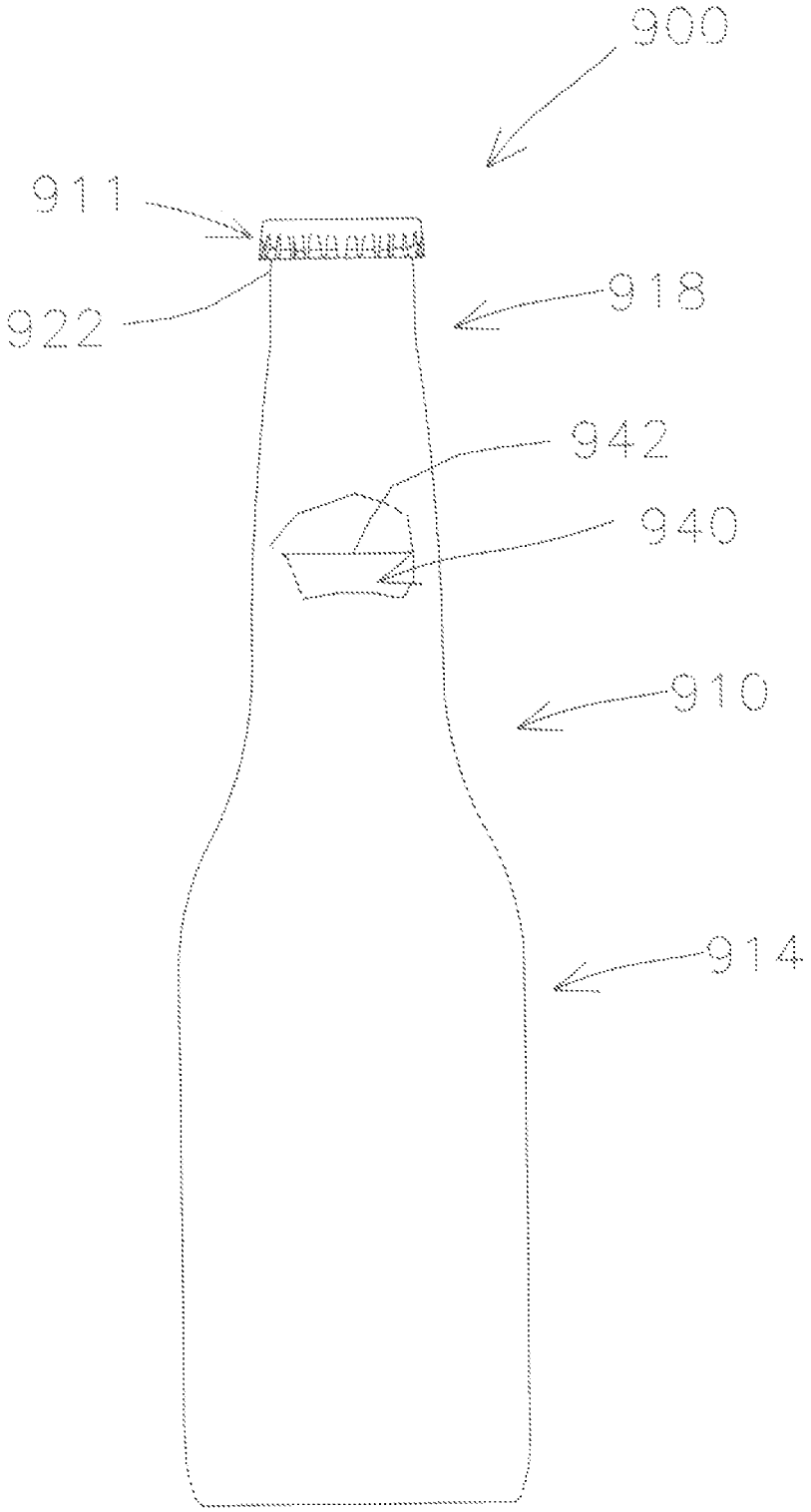
FIG. 19 is a side elevation view of a filled and crowned metal bottle container of the type shown in FIG. 12.

FIG. 19 illustrates a beverage filled container package 900. The package includes a container 910, which may be identical to container 710 shown in FIG. 12. The metal container body 910 may have having a body portion 914 with a first diameter and a reduced diameter neck portion 918 terminating in an opening (not visible in FIG. 18). A plastic ring (not visible in FIG. 18, which may be identical to ring 740 or 780, FIGS. 13 and 17, is attached to the neck portion 918 in the finish are 922 adjacent the opening. An appropriate (pry-off or twist-off) crown 911 engages the plastic ring and sealingly covers the opening. A liquid 940, such as beer or soda, fills a portion of the container 910 up to fill line 942, which in one embodiment leaves a conventional amount of "head space" between the fill line 942 and the crown 911.

Metal container bodies in a 16 fl-oz size may be provided by using the same configuration and metal thicknesses as the bottles described with reference to FIGS. 9-11, except that the length of the cylindrical body portion, is greater. Such 16 oz containers without an insert/outsert may each have a total aluminum weight of about 32.1 g such that k=2.006 g/fl-oz. In a light weighted version of the 16 fl-oz container having an outsert ring, such as outsert ring 740 described below for container 710, is used to facilitate crowning. The outsert ring enables the wall thickness of the 16 fl-oz container to be reduced in the same manner described in FIG. 18. The weight of the light weighted 16 fl-oz container may be reduced to about 26.0 g. The value k of the light weighted 16 fl-oz aluminum container may then be reduced to 2.006 g/fl-oz.

The foregoing description of specific embodiments has been presented for purposes of illustration and description. The specific embodiments described are not intended to be exhaustive or to suggest a constraint to the precise forms disclosed, and many modifications and variations are possible in light of the above teaching. For example, the various plastic insert and outsert rings described herein could be constructed from material other than plastic, such as for example, another nonmetallic, material like carbon fiber or a metal, such as steel. The sizes and shapes of the metal bottles could also be different than those specifically described herein. Also, rather than crowning the metal container bottles with a standard steel crown and standard crowning machinery, different types of crowns having different axial forces applied during crowning could be used. When the axial crowning force is reduced, the bottle wall thickness may, up to a point, also be correspondingly reduced. The illustrated embodiments were chosen and described in order to best explain principles and practical application, to thereby enable others skilled in the art to best utilize the various embodiments with various modifications as are suited to the particular use contemplated. It is intended that the scope of the invention be defined only by the claims appended hereto and their equivalents, except as limited by the prior art.

What is claimed is:

1. A container comprising:

a drawn and ironed aluminum container body having:

a cylindrical body portion with a relatively constant outer diameter, a top end and a bottom end;

a varying diameter neck portion, integrally connected to said top end of said cylindrical body portion by a shoulder portion and terminating in an opening; and a container bottom portion integrally connected to said bottom end of said cylindrical body portion;

wherein said shoulder portion and said neck portion have a combined axial length of at least about 5 in.;

wherein said varying diameter shoulder portion has a maximum metal thickness of about 0.01 in and comprises:

a first arcuate portion having a radius of curvature of about 2.0 in with a center of curvature located at about the same height as said top end of said cylindrical body portion;

a second arcuate portion intersecting said first arcuate portion, said second arcuate portion having a radius of curvature of about 2.5 in with a center of curvature located about 2 in above said top end of said cylindrical body portion;

wherein said varying diameter neck portion has a maximum metal thickness of less than about 0.02 in and comprises a first arcuate portion having a radius of curvature of about 16.5 in with a center of curvature located at a height of about 6 in above a bottom end of said bottom portion of said container;

wherein said container is a 12 fl-oz long neck bottle having an aluminum weight to nominal container volume ratio ("k") of less than about 2.8 g/fl-oz.; and wherein said drawn and ironed aluminum container body is constructed and arranged to receive a metal crown applied by conventional glass bottle crowning equipment without crushing deformation of said container body.

2. The container of claim 1 wherein k is less than about 2.3 g/fl-oz.

3. The container of claim 1 further comprising a ring mounted on said neck portion.

4. The container of claim 3 wherein said ring is adapted to engage said metal crown.

5. The container of claim 1, wherein said opening is defined by an annular rolled metal portion.

6. The container of claim 5 wherein said annular rolled metal portion is adapted to engage said metal crown.

7. The container of claim 6, further comprising a ring mounted on said neck portion.

8. The container of claim 1 said container bottom portion comprising a central dome wall and a ring structure connecting said dome wall to said container body portion.

9. The container of claim 8 wherein said ring structure comprises an outer wall portion connected to said container body portion and substantially aligned therewith.

10. The container of claim 9 wherein said outer wall portion of said annular ring structure slopes downwardly and inwardly from said container body portion at an angle of less than about 6°.

11. The container of claim 10 wherein said outer wall portion slopes downwardly and inwardly from said container body portion at an angle of about 3°.

12. The container of claim 9 wherein said ring structure comprises an annular inner wall and an annular arcuate foot portion; said annular inner wall and said annular outer wall being connected to opposite ends of said annular arcuate foot portion.

13. The container of claim 1 wherein said shoulder portion first arcuate portion has a surface dimension measured from a bottom edge to a top edge thereof of about 0.9 in.

14. The container of claim 13 wherein said shoulder portion second arcuate portion has a surface dimension measured from a bottom edge to a top edge thereof of about 1.2 in.

15. The container of claim 14 wherein said surface dimension of said first arcuate portion of said neck portion is about 2.3 in.

* * * * *